US005275002A

United States Patent [19]

Inoue et al.

[11] Patent Number: 5,275,002

[45] Date of Patent: Jan. 4, 1994

[54] PULSE TUBE REFRIGERATING SYSTEM

[75] Inventors: Tatsuo Inoue, Anjo; Akira Tominaga, Tsuchiura, both of Japan

[73] Assignee: Aisin Newhard Co., Ltd., Kariya, Japan

[21] Appl. No.: 6,855

[22] Filed: Jan. 21, 1993

[51] Int. Cl.[5] ..... F25B 9/00

[52] U.S. Cl. ..... 62/6; 60/520; 62/467

[58] Field of Search ..... 62/6, 467; 60/520

[56] References Cited

U.S. PATENT DOCUMENTS

| | | | |
|---|---|---|---|
| 4,397,155 | 8/1983 | Davey | 62/6 |
| 4,498,296 | 2/1985 | Dijstra et al. | 62/6 |
| 4,543,793 | 10/1985 | Chellis et al. | 62/6 |
| 4,872,313 | 10/1989 | Kazumoto et al. | 62/6 |
| 4,953,366 | 9/1990 | Swift et al. | 62/467 |
| 5,156,005 | 10/1992 | Redlich | 62/6 |

OTHER PUBLICATIONS

A Review Of Pulse Tube Refrigeration, Advances in Cryogenic Engineering, vol. 35, P.1191/1990.

Y. Matsubara and A. Miyake, Alternative Methods Of The Orifice Pulse Tube Refrigerator, In: "Proc. Fifth Intl. Cryocooler Conf.," (1988) p. 127.

*Primary Examiner*—Ronald C. Capossela

*Attorney, Agent, or Firm*—Finnegan, Henderson, Farabow, Garrett and Dunner

[57] ABSTRACT

A pulse tube refrigerating system includes a first space, a second space, a pulse tube disposed between the first and the second spaces so as to constitute a closed operating space in which an amount of operating fluid is filled, a driving device for establishing opposite phase fluctuations of the operating fluid by an expansion and an compression of the first space and the second space in alternative manner, a first set of a radiator and an accumulator disposed in the pulse tube so as to be located at a side of the first space, a second set of a radiator and an accumulator disposed in the pulse tube so as to be located at a side of the second space, a phase control oscillator disposed in the pulse tube and set to be be vibrated with a phase relative to the fluctuation of the operating fluid, and a control device for controlling the phase of the phase control oscillator relative to the fluctuation of the operating fluid.

7 Claims, 6 Drawing Sheets

PULSE TUBE REFRIGERATING SYSTEM

BACKGROUND OF THE INVENTION

The present invention relates to a pulse tube refrigerating system.

In a conventional pulse tube refrigerating system, a compression space, a radiator, an accumulator and a pulse tube are arranged in series so as to constitute a closed operating space. Within the closed operating space, there is filled an amount of operating fluid such as helium gas, and the pressure of the operating fluid is set to be varied due to the compression at the compression space. This results in an establishment of a phase difference between the pressure vibration and the displacement vibration of the operating fluid, which leads to that a heat is set to be absorbed at a lower temperature terminal or a cold head of the pulse tube and the resulting heat is radiated from the radiator. Thus, the lower temperature terminal or the cold head of the pulse tube is cooled or lowered at a set temperature.

In order to improve the thermal transfer ability, it is well known that the setting of the phase difference at about 90 degrees is effective. This fact can be known from a thesis, for example, reported in "Advances in Cryogenic Engineering, Vol. 35, P1191/1990). On the basis of this, an improved pulse tube refrigerating system has been proposed in a report (Proc. Fifth International Cryocooler conf. (1988) P.127). In the improved pulse tube refrigerating system, a phase shifter includes a buffer tank which is used as a Helmholtz resonator and the resultant resonant frequency $\omega_0$ is set to be more than the driving or fluctaion frequency $\omega$ of the operating fluid in order to establish the phase difference of about 90 degrees between the pressure vibration and the displacement vibration of the operating fluid as possible, thereby improving the heat transfer ability of the accumulator.

However, in the foregoing apparatus or device, the driving or fluctaion frequency of the operating fluid is restricted by the resonant frequency of the phase shifter, resulting in that foregoing apparatus is not so flexible for the practical use.

SUMMARY OF THE INVENTION

It is, therefore, a principal object of the present invention is to provide a pulse tube refrigerating system in which the driving or fluctaion frequency of the operating fluid is out of the question in order to establish an about 90-degree phase difference between the pressure vibration and the displacement vibration of the operating fluid.

The second object of the present invention is to provide a pulse tube refrigerating system in which a 90-degree phase difference between the pressure vibration and the displacement vibration of the operating fluid is obtained by an electrical control manner.

The third object of the present invention is to provide a pulse tube refrigerating system in which a 90-degree phase difference between the pressure vibration and the displacement vibration of the operating fluid is established and which is in the form of a motor driven compressor operated refrigerating system.

The fourth object of the present invention is to provide a pulse tube refrigerating system in which a 90-degree phase difference between the pressure vibration and the displacement vibration of the operating fluid is established and which is in the form of a pump type compressor operated refrigerating system.

The fifth object of the present invention is to provide a pulse tube refrigerating system in which a 90-degree phase difference between the pressure vibration and the displacement vibration of the operating fluid is established and which is in the form of a Stirling engine operated refrigerating system.

The sixth object of the present invention is to provide a pulse tube refrigerating system in which a 90-degree phase difference between the pressure vibration and the displacement vibration of the operating fluid is established and which has a counter-flow type accumulator.

The seventh object of the present invention is to provide a pulse tube refrigerating system to which a 90-degree phase difference between the pressure vibration and the displacement vibration of the operating fluid is established and which is in the form of a multi-stage type Stirling engine operated refrigerating system.

In order to attain the foregoing objects, a pulse tube refrigerating system is comprised of a first space, a second space, a pulse tube disposed between the first and the second spaces so as to constitute a closed operating space in which an amount of operating fluid is filled, a driving device for establishing opposite phase fluctuations of the operating fluid by an expansion and an compression of the first space and the second space in alternative manner, a first set of a radiator and an accumulator disposed in the pulse tube so as to be located at a side of the first space, a second set of a radiator and an accumulator disposed in the pulse tube so as to be located at a side of the second space, a phase control oscillator disposed in the pulse tube and set to be vibrated with a phase relative to the fluctuation of the operating fluid, and a control device for controlling the phase of the phase control oscillator relative to the fluctuation of the operating fluid.

BRIEF DESCRIPTION OF THE DRAWINGS

The above and other objects, features and advantages of the present invention will be more apparent and more readily appreciated from the following detailed description of preferred exemplarily embodiment of the present invention, taken in connection with the accompanying drawings, in which.

DESCRIPTION OF THE PREFERRED EMBODIMENTS

Preferred embodiments of the present invention will be described hereinunder in detail with reference to the accompanying drawings.

Figure 1:
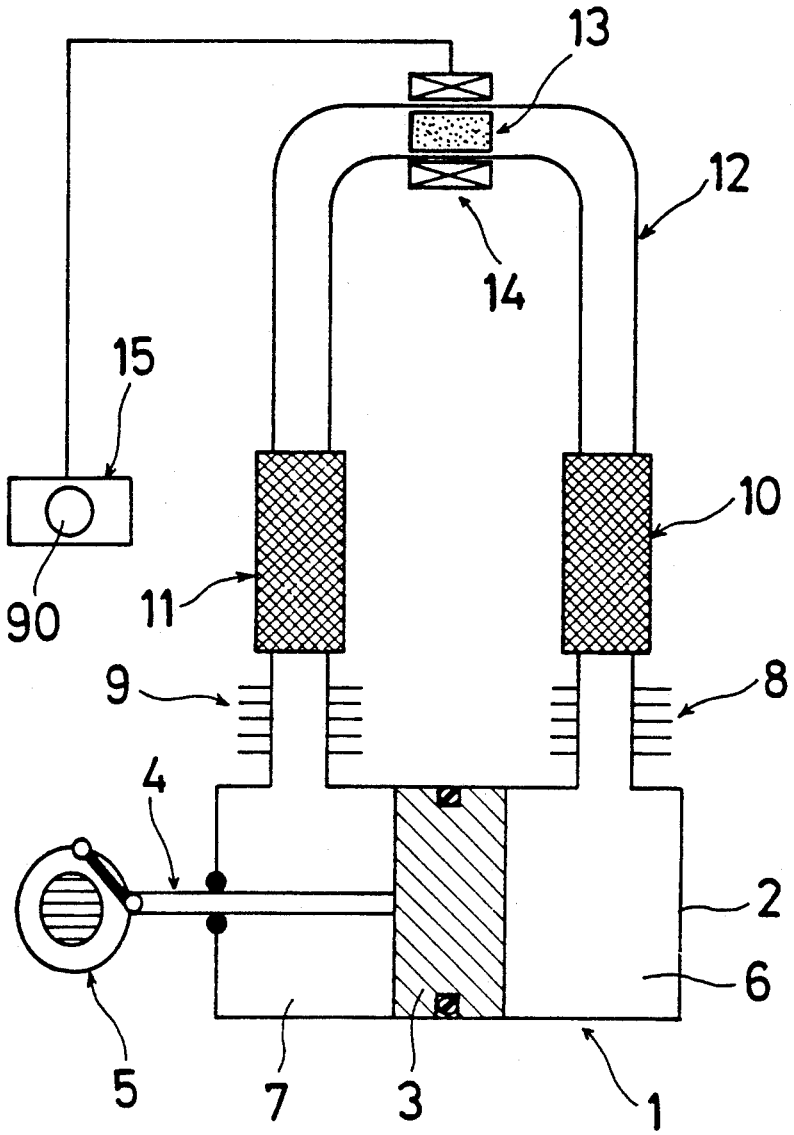
FIG. 1 is a block diagram of a first embodiment of a pulse tube refrigerating system in accordance with the present invention.

Referring first to FIG. 1 which illustrates a block diagram of a first embodiment of a pulse tube refrigerating system in accordance with the present invention, a compressor 1 which includes a cylinder 2 and a piston 3 which is movably mounted within the cylinder 2. The piston 2 is operatively connected via a link mechanism 4 to a motor 5 so as to be brought into reciprocating movement when the motor 5 is turned on. Within the cylinder 2, a first space 6 and a second space 7 are defined across the piston 2. Each of the spaces 6 and 7 is used alternately as a compression space and an expansion space. The first space 6 is connected to a heat-exchanger 8 and an accumulator 10 and the second space 7 is connected to a heat-exchanger 9 and an accumulator 11. In addition, a pulse tube 12 having a hollow interior is disposed between the accumulators 10 and 11. Thus, as a whole, a closed space is defined between the first space 6 and the second space 7. Within the closed space an amount of operating fluid is filled. As the operating fluid, helium, neon, argon, hydrogen, air, and nitrogen are available.

In the pulse tube 12, there is provided a phase control oscillator or vibrator 13 which is in the form of a permanent magnet. The phase control oscillator 13 is set to be vibrated with a phase relative to the piston 3 when the pressure variation in the operating fluid is changed due to the reciprocating movement of the piston 3. A coil 14 is wound around the phase control oscillator 13 in order to convert the kinetic energy into the equivalent electric energy. The coil 14 is connected to a controller 15 which includes a load resister 90. By adjusting the value of the resister 90, the phase of the phase control oscillator 13 relative to the piston 3 or the phase difference between the vibration of the phase control oscillator 13 and the pressure vibration of the operating fluid caused by the piston 3 can be controlled. This principle will be detailed hereinafter. In the foregoing structure, the phase control oscillator 13 and the coil 14 are under the normal temperature.

Figure 6:
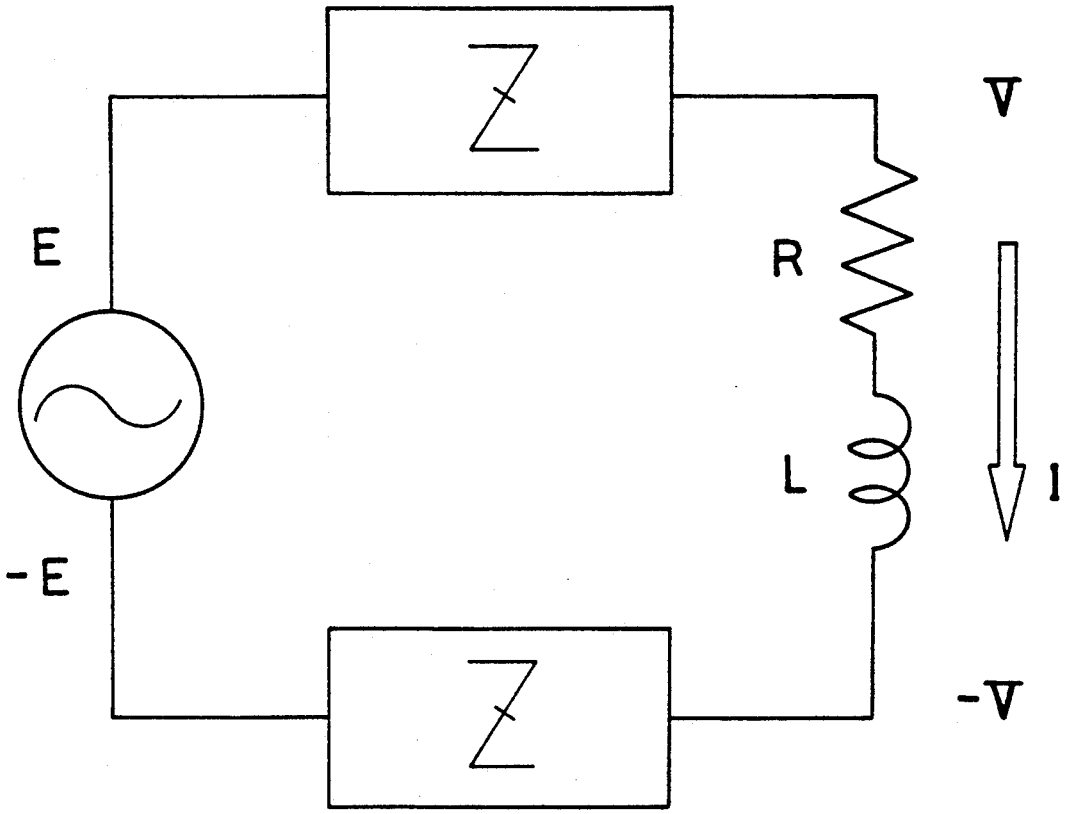
FIG. 6 shows an electric circuit which is equivalent to the structure in FIG. 1.

For explaining the foregoing principle, first of all, FIG. 6 shows a circuit which is equivalent to the structure shown in FIG. 1. In the equivalent circuit a reference code of Z denotes an in-series impedance of the regenerator 10 (11) and the pulse tube 12, an AC power supply corresponds to the cylinder 2, and the load of the phase control oscillator 13 is represented as an LR-series circuit. From the symmetry across the LR series circuit, when the voltages at opposite ends of the LR-series circuit are defined as V and $-V$, respectively, the formula of $I/2V=1/(R+i\ \omega L)$ where I represents a current passing through the LR series circuit. This formula can be also expressed as or transformed into $(I/i\omega)/V=2/(-\omega^2L+i\omega L)$. From this formula, if L is set to be zero, the left side of this formula becomes $-2i/\omega R$, which means that the displacement delays by 90 degrees relative to the pressure in phase. On the other hand, if R is set to be zero, the left side of this formula becomes $-2/\omega^2$ L, which means that the displacement delays by 180 degrees relative to the pressure in phase. In general, it is revealed that the displacement of the phase control oscillator 13 delays an angle of $\theta=\arctan(-R/\omega L)$ relative to the pressure change in the operating fluid. Thus, by setting the value of R by the controller 15 at an optical value, any desired $\theta$ can be obtained.

In operation, when the motor 5 is turned on, the piston 3 is brought into its reciprocating movement. Thus, the fluid at a side of the first space 6 and the fluid at a side of the second space 7 are vibrated in opposite phase, which results in pressure variation. Consequently, a phase difference is established between the vibration of the phase control oscillator 13 and the pressure vibration of the operating fluid, whereby a heat transfer in each of the accumulators 10 and 11 is established which leads to a cooling at a cold head or a conjunction between the pulse tube 12 and each of the accumulators 10 and 11. At this time, since the phase of phase control oscillator 13 relative to the piston depends on the load resister 90 in the controller 15, by determining an adequate value of the load resister 90, the phase difference can approach substantially 90 degrees. Thus, the heat-transfer ability is increased or improved at each of the accumulators 10 and 11, thereby cooling the cold heads of the pulse tube 12 which is at opposite ends of the pulse tube 12 are cooled. It is to be noted that the phase control oscillator 13 is set to be in synchronization with the piston 3, and acts equally on both sides at the first space 6 and the second space 7.

As mentioned above, the phase control oscillator 13 is set to be moved due to the differential pressure between both sides of the first space 6 and the second space 7, which means that resonance is not required for driving the phase control oscillator 13. Thus, the driving frequency of the phase control oscillator 13 can't be limited or restricted, and is free from any other frequency. In addition, for obtaining an optimal cryogenic temperature at the pulse tube 12, the adjustment of the load resister 90 of the controller 15 is available.

Figure 2:
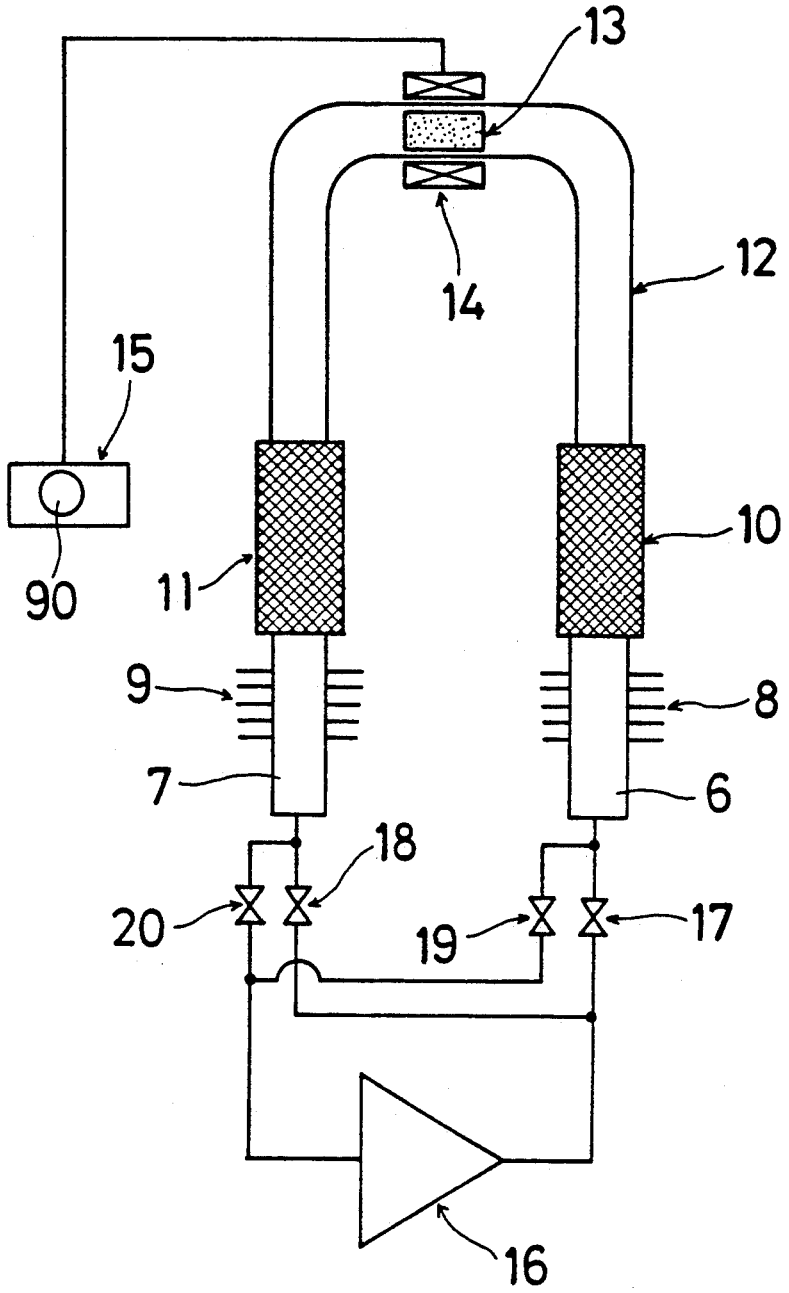
FIG. 2 is a block diagram of a second embodiment of a pulse tube refrigerating system in accordance with the present invention.

Referring to FIG. 2 wherein is shown a second embodiment of a pulse tube refrigerating system in accordance with the present invention, the first space 6 and the second space 7 are connected, via a discharge valve 17 and a discharge valve 18 to a discharge side of a compressor 16 as well as the first space 6 and the second space 7 are connected, via an intake valve 19 and an intake valve 20 to an intake side of a compressor 16. Thus, alternate operations of the discharge valve 19 and the intake valve 18 (the discharge valve 20 and the intake valve 17) in opposite phase are established when the compressor 16 is turned on, which results in that the expansion and the compression of each of the first space 6 and the second space 7 are established.

Figure 3:
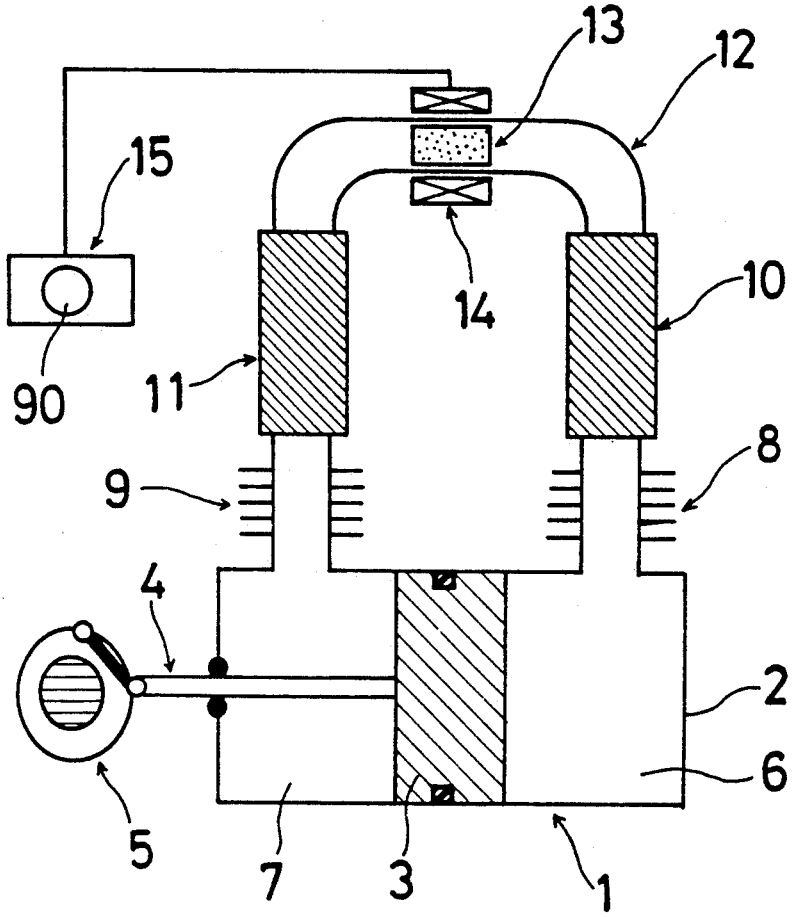
FIG. 3 is a block diagram of a third embodiment of a pulse tube refrigerating system in accordance with the present invention.

Referring to FIG. 3 wherein is shown a second embodiment of a pulse tube refrigerating system in accordance with the present invention, the phase control oscillator 13 can be located near the cooled portion by shortening the pulse tube 12. The resulting structure leads to that the pulse tube refrigerating system acts as a Stirling refrigerator.

Figure 4:
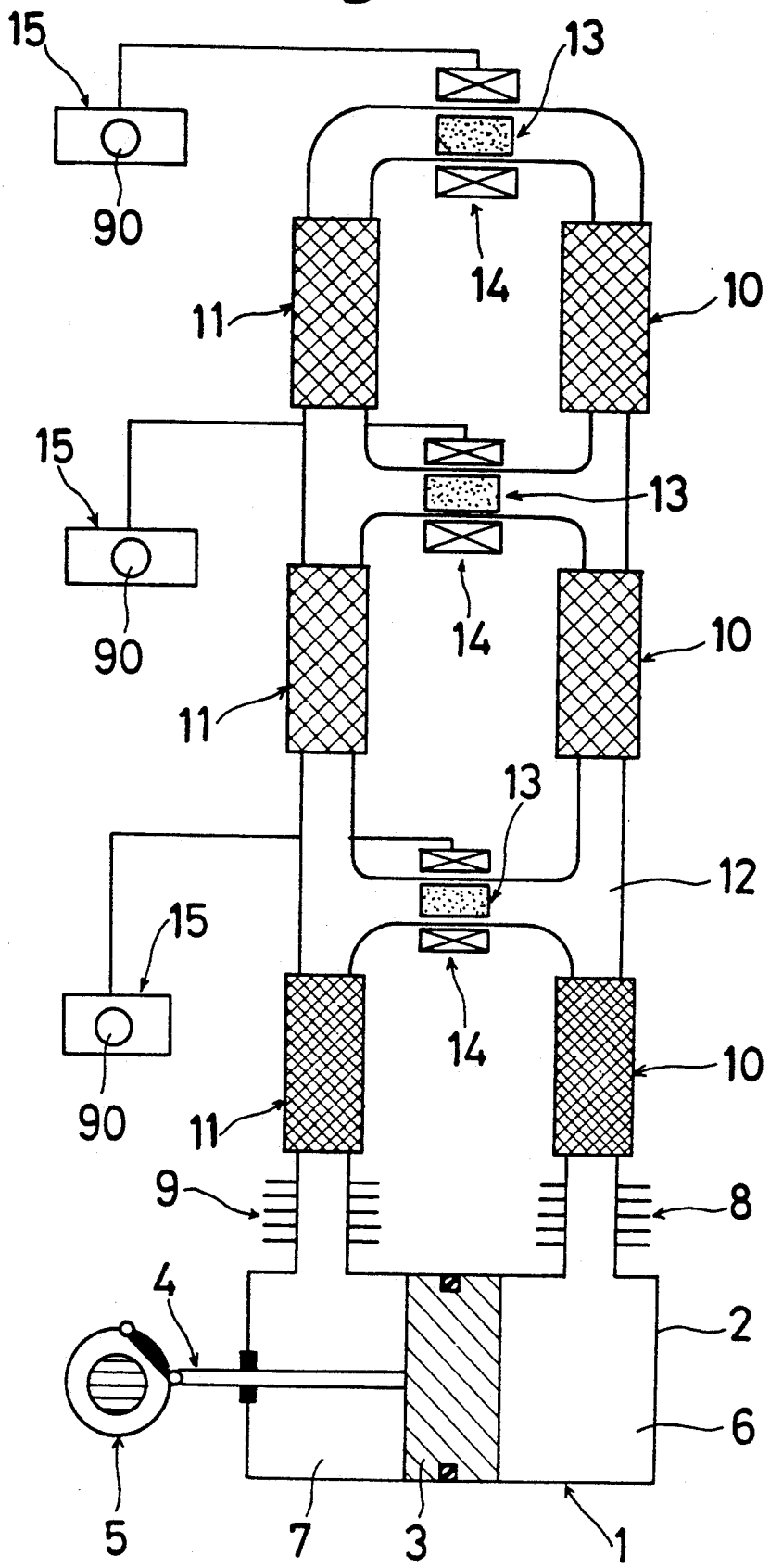
FIG. 4 is a block diagram of a fourth embodiment of a pulse tube refrigerating system in accordance with the present invention.

In addition, a third embodiment of a pulse tube refrigerating system in accordance with the present invention is illustrated in FIG. 4 wherein Stirling refrigerators are arranged so as to constitute a three-stage refrigerator. In each stage, an independent phase adjustment can be established.

Figure 5:
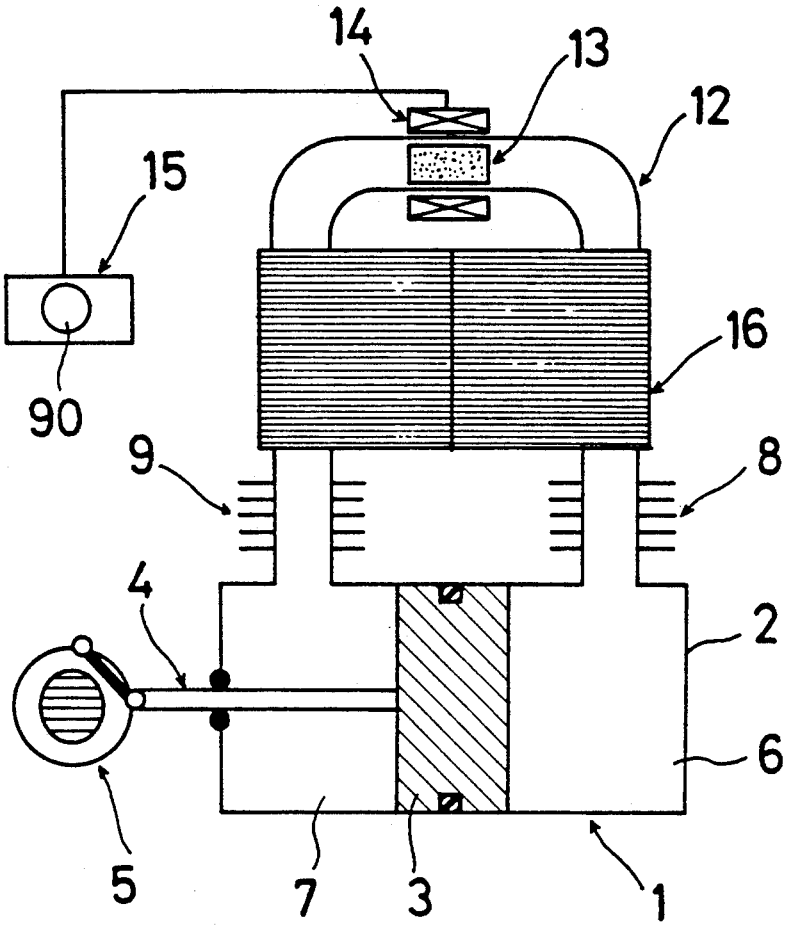
FIG. 5 is a block diagram of a fifth embodiment of a pulse tube refrigerating system in accordance with the present invention.

Moreover, as shown in FIG. 5 wherein is shown a fifth embodiment of a pulse tube refrigerating system in accordance with the present invention, instead of the spaced accumulators 10 and 11 in FIG. 1, a counter-flow type accumulator 16 is employed which is in the form a thermally connected accumulators 10 and 11 in FIG. 1. The resulting structure enables a direct thermal exchange between two flows of the operating fluid, thereby assuring an operation of the pulse tube refrigerating system. The reason is that even if the heat capacity of each of the accumulators 10 and 11 in FIG. 1, is insufficient the deficient quantity can be compensated by the foregoing direct thermal exchange.

The invention has thus been shown and described with reference to reference to specific embodiments, however, it should be noted that the invention is in no way limited to the details of the illustrated structures but changes and modifications may be made without departing from the scope of the appended claims.

What is claimed is:

1. A pulse tube refrigerating system comprising:

a first space;

a second space;

a pulse tube disposed between the first and the second spaces so as to constitute a closed operating space in which an amount of operating fluid is filled;

driving means for establishing opposite phase fluctuations of the operating fluid by an expansion and an compression of the first space and the second space in alternative manner;

a first set of a radiator and an accumulator disposed in the pulse tube so as to be located at a side of the first space;

a second set of a radiator and an accumulator disposed in the pulse tube so as to be located at a side of the second space;

a phase control oscillator disposed in the pulse tube and set to be be vibrated with a phase relative to the fluctuation of the operating fluid; and control means for controlling the phase of the phase control oscillator relative to the fluctuation of the operating fluid.

2. A pulse tube refrigerating system in accordance with claim 1, wherein the phase control oscillator is in the form of a permanent magnet, the control means includes a wire wound around the pulse tube for constituting an electric generator, and a current generated at the electric generator is supplied to the control means for being adjusted which leads to the control of the phase difference between the phase control oscillator and the fluctuation of the operating fluid.

3. A pulse tube refrigerating system in accordance with claim 1, wherein the driving means includes a motor, a piston across which the first space and the second space are defined, a link mechanism disposed between the motor and the piston.

4. A pulse tube refrigerating system in accordance with claim 1, wherein the driving means includes a compressor and valve means connected to each of the first and the second spaces.

5. A pulse tube refrigerating system in accordance with claim 1, wherein the phase control oscillator is located near one of the accumulators.

6. A pulse tube refrigerating system in accordance with claim 1, wherein the accumulators are in direct thermal connection for establishing a counter-flow type accumulator.

7. A pulse tube refrigerating system in accordance with claim 1 further comprising another set of accumulators disposed in the pulse tube so as to be located at sides of the first accumulator and the second accumulator, respectively, another phase control oscillator disposed in a bypass passage of the pulse, another control means for controlling the phase of the corresponding phase control oscillator relative to the fluctuation of the operating fluid.

* * * * *

UNITED STATES PATENT AND TRADEMARK OFFICE

CERTIFICATE OF CORRECTION

PATENT NO. : 5,275,002

DATED : January 4, 1994

INVENTOR(S) : Tatsuo Inoue et al.

It is certified that error appears in the above-indentified patent and that said Letters Patent is hereby corrected as shown below:

On title page, item [56] insert "FOREIGN APPLICATION PRIORITY DATA"
--Jan. 22, 1992 [JP] Japan 4-9363.--

Signed and Sealed this

Thirty-first Day of January, 1995

*Attest:*

Bruce Lehman

BRUCE LEHMAN

*Attesting Officer*

*Commissioner of Patents and Trademarks*